US005632553A

United States Patent [19]

Huang

[11] Patent Number: 5,632,553

[45] Date of Patent: May 27, 1997

[54] FREESTANDING LAMP HAVING MODULAR CONNECTION

[76] Inventor: Thomas M. Huang, 5649 N. Peck Rd., Arcadia, Calif. 91006

[21] Appl. No.: 387,239

[22] Filed: Feb. 13, 1995

[51] Int. Cl.[6] ..... F21S 1/12

[52] U.S. Cl. ..... 362/410; 362/220; 362/225; 362/250; 362/287; 362/419; 362/431

[58] Field of Search ..... 362/410, 220, 362/225, 233, 250, 285, 287, 413, 419, 422, 431

[56] References Cited

U.S. PATENT DOCUMENTS

| | | | |
|---|---|---|---|
| D. 282,011 | 12/1985 | Fackert | D26/62 |
| 1,802,460 | 4/1931 | Doane . | |
| 2,965,751 | 12/1960 | Stiffel . | |
| 2,977,566 | 3/1961 | Neumann et al. . | |
| 3,348,188 | 10/1967 | Wood . | |
| 3,378,681 | 4/1968 | Meyer et al. . | |
| 3,711,695 | 1/1973 | Orbach | 362/410 |
| 4,232,183 | 11/1980 | Person | 174/48 |
| 4,473,869 | 9/1984 | DeWidt | 362/431 |
| 4,956,757 | 9/1990 | Wang | 362/252 |
| 5,016,154 | 5/1991 | Leeyah | 362/414 |
| 5,221,141 | 6/1993 | Swanson | 362/250 |
| 5,381,326 | 1/1995 | Yeh | 362/431 |

FOREIGN PATENT DOCUMENTS

| | | | |
|---|---|---|---|
| 640672 | 6/1962 | Italy | 362/410 |

*Primary Examiner*—Ira S. Lazarus
*Assistant Examiner*—Alfred Basichas
*Attorney, Agent, or Firm*—Sheldon & Mak

[57] ABSTRACT

A floor lamp includes a base, an upstanding base column on the base, a housing fixedly supported atop the base column; a base electrical connector mounted on the housing and having recessed contacts that are oriented for receiving mating contacts engaging parallel to the column, electrical conductors extending within the base column for connecting the contacts to an external source. A lamp module of the floor lamp includes a module column, an illuminating fixture at one end of the module column, a module electrical connector mounted to the other end of the column and having the mating contacts projecting therefrom, the fixture being electrically connected between the mating contacts. A clamp nut rotatably retained on the lamp module supportively secures the lamp module on the base electrical connector by threadingly engaging a threaded shell of the base connector, thereby releasably clamping the module on the base column with the contacts in mating engagement. In one configuration, the lamp further includes a lamphead that is supported in a desired position and orientation relative to the housing on a curvable gooseneck that projects from the housing, the gooseneck being sufficiently long for holding a full loop thereof while supporting the lamphead, the lamphead also being powered from the electrical conductors.

16 Claims, 2 Drawing Sheets

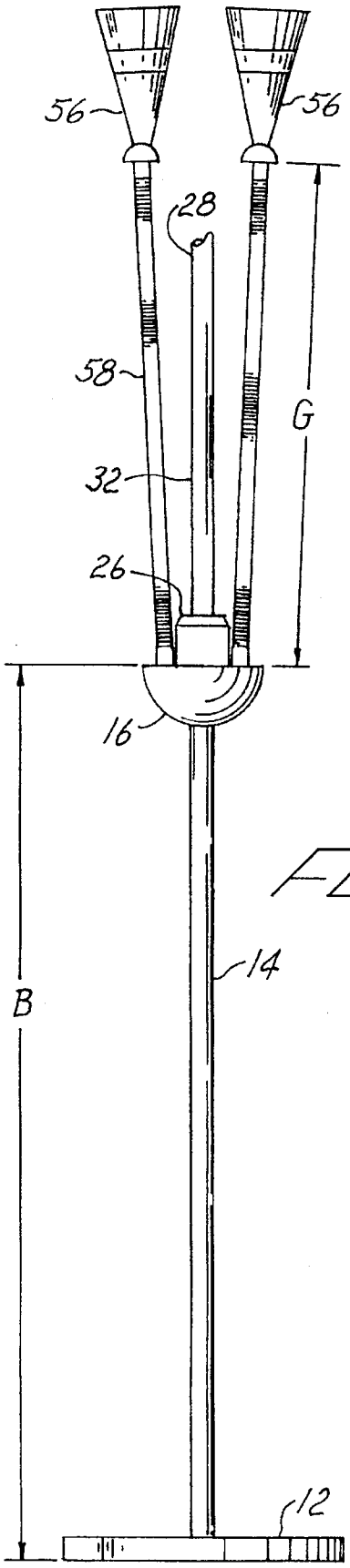
FIG. 5
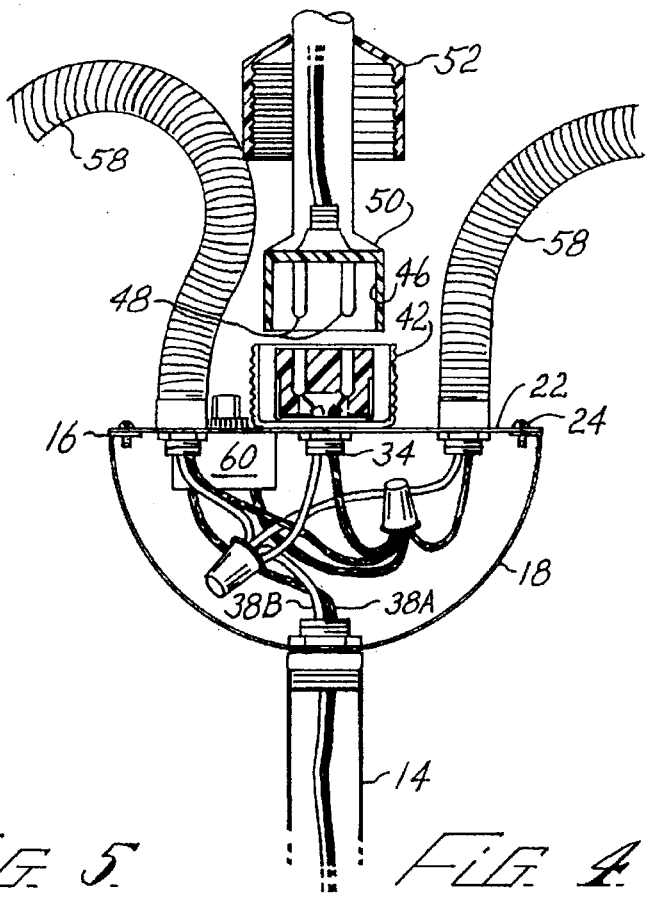
FIG. 4
FIG. 6
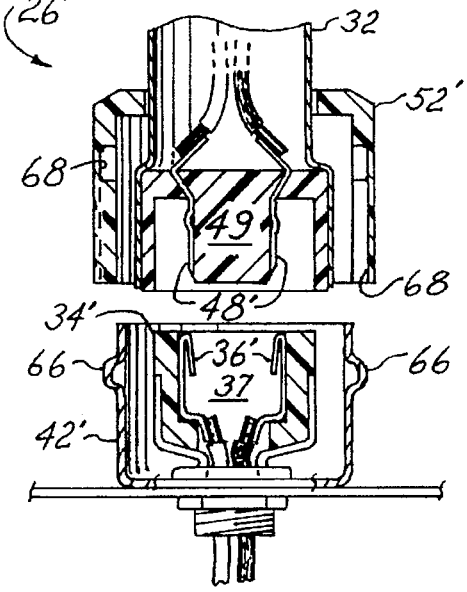

FREESTANDING LAMP HAVING MODULAR CONNECTION

BACKGROUND

The present invention relates to electric room lighting, and more particularly to free-standing lamps such as floor lamps and table lamps.

Floor lamps of the prior art typically have a base, a column extending upwardly from the base to from four to six feet above floor level, with one or more luminaries thereon for providing area lighting, task lighting, or a combination thereof. See, for example, U.S. Pat. No. 5,221,141 to Swanson. Area lighting is usually provided by a light source that is fixed at the top of the column, and task lighting, if present, is provided from one or more heads that are adjustably mounted on the column at intermediate locations. Table lamps have similar construction except that the column is foreshortened or combined with the base.

Among the problems exhibited by the above-identified lamps are the following:

1. They are expensive to store and/or ship in that they are excessively bulky when assembled, particularly when the column is in one piece;
2. They are awkward and difficult to assemble in the field when they are shipped in a broken-down (disassembled) condition.
3. They are ineffective in that task lighting is difficult and/or impossible to locate and orient as desired, particularly when spaced-apart tasks are to be lighted; and
4. They lack versatility in that the presence of an area illuminated at the top of the column is not optional.

Thus there is a need for a floor lamp that overcomes these disadvantages.

SUMMARY

The present invention meets this need by providing a free-standing lamp that is particularly versatile and effective for providing a desired combination of area and task lighting. In one aspect of the invention, the lamp includes a base; a base electrical connector mounted in a fixed position relative to the base and having at least two recessed contact elements, the contact elements being oriented for receiving mating contacts, the base electrical connector having electrical conductors extending therefrom for connection to an external source; a lamp module including a module structure, a lamp fixture supported by the structure, a module electrical connector mounted to a lower extremity of the structure and having at least two projecting contact elements that are oriented for engagement as the mating contacts, and means for electrically connecting the lamp fixture between the projecting contact elements; and means for supportivety securing the fixture module on the base electrical connector for powering the fixture from the external source.

The lamp can include an upstanding base column member fixably connected to the base and having a column axis at an upper extremity thereof. The base electrical connector can be mounted to an upper extremity of the base column, the electrical conductors extending within the base column. The base electrical connector can be mounted in line with the column axis. Preferably the contact elements are oriented for receiving the mating contacts engaging parallel to the column axis.

The means for securing can include a ring member and a support element, the ring member being formed for rotatably engaging the support element, the ring member being rotatably retained relative to one of the base and the lamp module, the support element being fixably located relative to the other of the base and the lamp module. The ring member can threadingly engage the support element, thereby releasably clamping the lamp module on the base with the contacts in mating engagement. The support element can be a threaded shell member fixedly supported proximate the upper extremity of the base, the ring member being a clamp nut that is retained on the lamp module. One of the support element and the ring member can have a plurality of radially projecting bosses formed thereon, the other of the support element and the ring member having corresponding L-shaped channels formed therein for engaging the bosses, the bosses entering the channels axially as the ring member engages the support element, the bosses entering horizontal legs of the channels during rotation of the ring member relative to the support element.

The lamp can further include a lamphead, an elongate, hollow curvable neck member having one end fixed relative to the base and a free end connected to the lamphead for supporting the lamphead in a desired position and orientation relative to the base, and means for electrically connecting the lamphead to the electrical conductors of the base electrical connector. Preferably the neck member is sufficiently long for holding a full loop thereof while supporting the lamphead. The neck member can be hollow, the means for electrically connecting the lamphead extending within the neck member. The lamp can include a housing fixedly supported above the base, the neck member extending from the housing. The lamp can include at least two the neck members supporting respective lampheads, the neck members being connected to the housing on opposite sides of the housing. The base connector can be mounted to an upper wall of the housing.

In another aspect of the invention, a free-standing lamp includes a base; and a housing fixedly supported above the base, a lamphead, an elongate, hollow curvable neck member having one end fixed relative to the base and a free end connected to the lamphead for supporting the lamphead in a desired position and orientation relative to the housing, the neck member being sufficiently long for holding a full loop thereof while supporting the lamphead, and electrical conductors extending from the base for connection of the lamphead to an external source.

The lamp can further include an upstanding base column fixably connected to the base and having a column axis at an upper extremity thereof, the conductors extending within the base column. The lamp can further include a housing mounted proximate the upper extremity of the base column, the neck member being mounted to the housing.

The lamp can further include a base electrical connector mounted in a fixed position relative to the base and having at least two recessed contact elements, the contact elements being oriented for receiving mating contacts, the base electrical connection having electrical conductors extending therefrom for connection to an external course, and means for electrically connecting the lamphead between the electrical conductors; a fixture module including a module structure, a fixture supported by the structure, a module electrical connector mounted to a lower extremity of the structure and having at least two projecting contact elements, the projecting contact elements being oriented for engagement as the mating contacts, and means for electrically connecting the fixture between the projecting contact elements; and means for supportively securing the fixture module on the base electrical connector for powering the fixture from the external source, the lamphead also being powered from the external source.

DRAWINGS

These and other features, aspects, and advantages of the present invention will become better understood with reference to the following description, appended claims, and accompanying drawings, where:

FIG. 4 is an elevational detail view as in FIG. 2, showing the column connection separated as in FIG. 3;

FIG. 5 is a front elevational view of the lamp of FIG. 1; and

FIG. 6 is an elevational detail view showing an alternative configuration of the column connection.

DESCRIPTION

Figure 1:
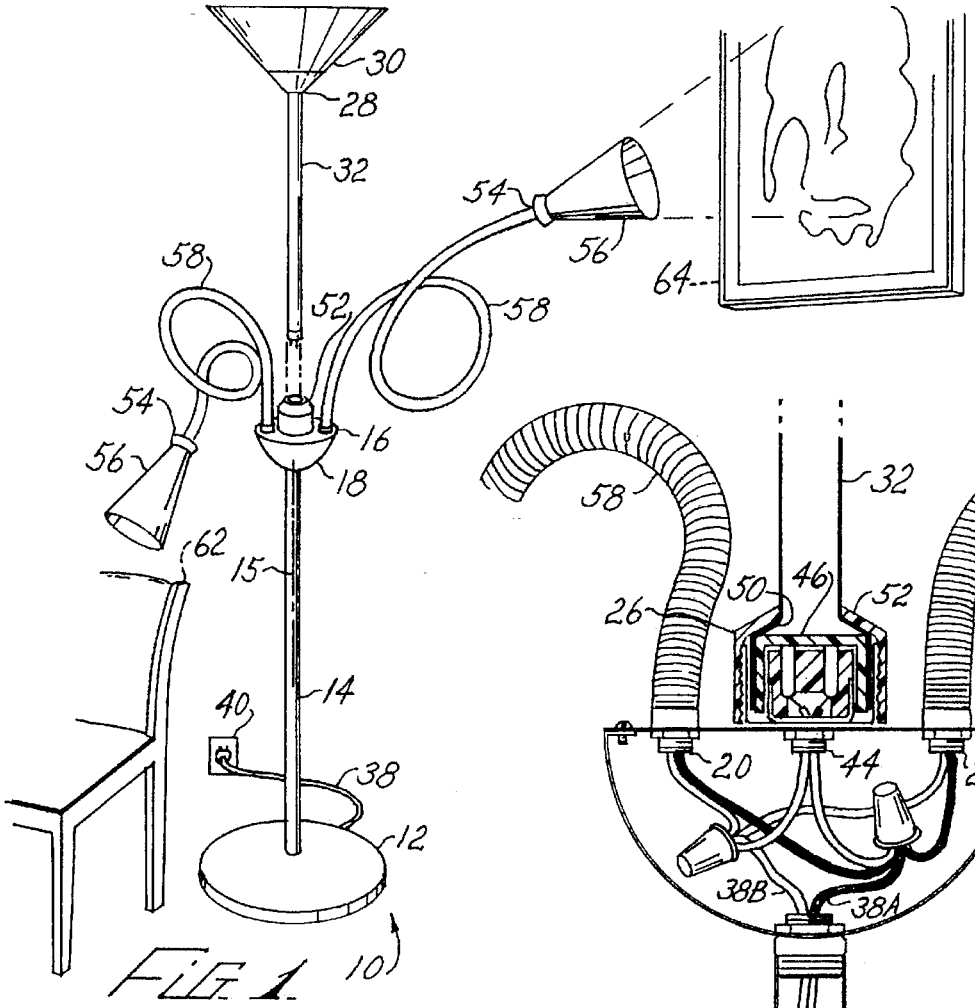
FIG. 1 is a front elevational perspective view of a floor lamp according to the present invention.

The present invention is directed to a free-standing lamp that is particularly versatile for providing desired combinations of area and task lighting. With reference to FIGS. 1–5 of the drawings, a lamp 10 includes a base 12 for support on a horizontal surface such as a floor or table, a tubular base column member 14 extending rigidly vertically from the base 12 on a column axis 15 to a housing 16 that is located at an intermediate elevation on the lamp 10, the housing 16 including a dish member 18 that is fastened by suitable conduit hardware 20 to an upper extremity of the base column member 14. The housing 16 also has a cover or lid member 22 that is fixedly mounted to the dish member 18 by screw fasteners 24.

Figure 2:
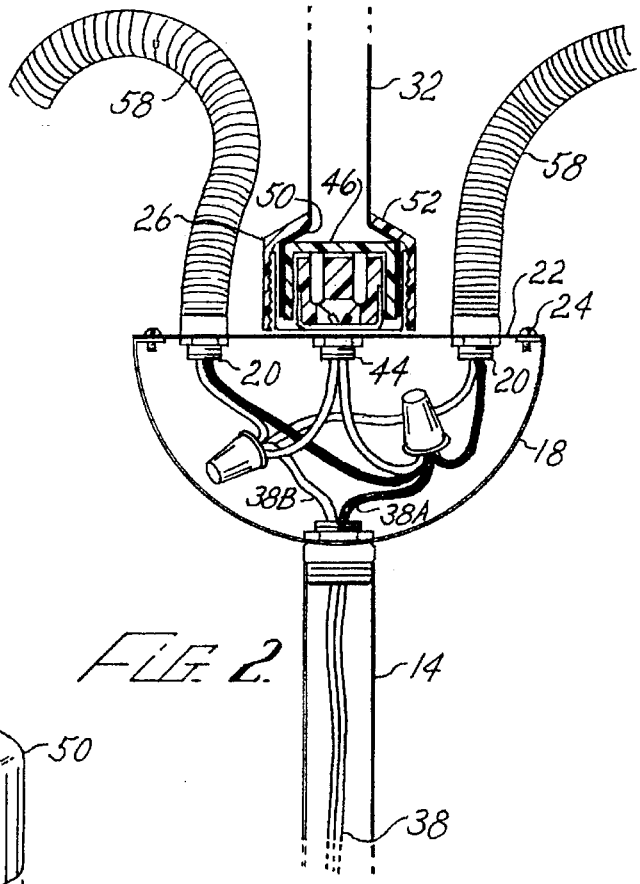
FIG. 2 is an elevational detail view showing a modular column connection of the lamp of FIG. 1.
Figure 3:
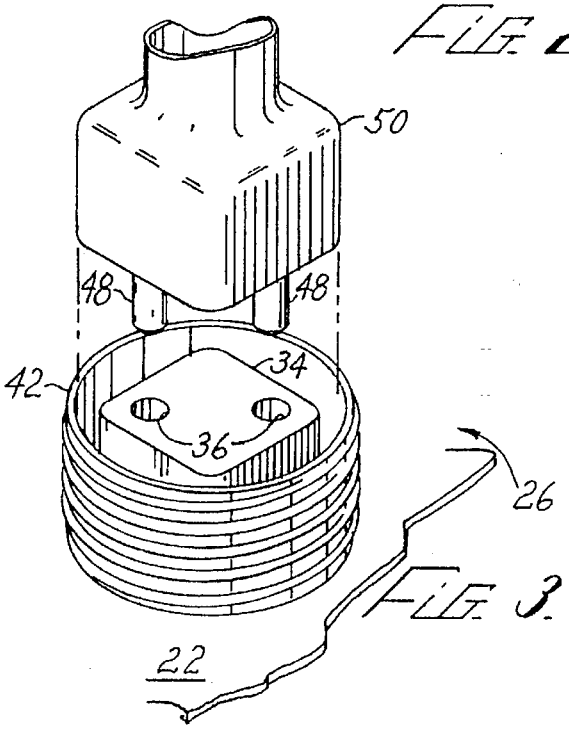
FIG. 3 is a perspective detail view of the column connection of FIG. 2 in a separated condition.

According to the present invention, the lamp 10 includes a column connector 26 for removably mounting a lamp module 28, the lamp module having a main light fixture 30 that is rigidly supported at an upper extremity of a fixture column 32, whereby the fixture column 32 is fixably connectable in line with the column axis 15. As best shown in FIGS. 2–4, the column connector 26 includes a base socket 34 having a pair of recessed electrical contact elements 36 therein, the contact elements 36 being connected in a conventional manner to respective conductors 38, designated 38A and 38B in FIG. 2, the conductors 38 extending downwardly within the base column 14 for connection to an external source 40 of electrical power as shown in FIG. 1. The column connector 26 also includes a threaded shell member 42, being clamped between the base socket 34 and the lid member 22 by a conduit clamp 44 that forms part of the base socket 34. The base socket 34, together with the threaded shell member 42, provides a base connector portion of the column connector 26, being rigidly mounted proximate the upper extremity of the base column member 14. The column connector 26 also includes a plug member 46 having a pair of projecting electrical contacts 48 for axial engagement with the recessed contact elements 36 of the base socket 34, the plug member 46 being affixed within an enlargement 50 at the lower extremity of the fixture column 32 as shown in FIG. 2. The column connector 26 further includes a clamp nut 52 that threadingly engages the threaded shell member 42, the clamp nut 52 rotatably engaging the fixture column 32 and bearing against the enlargement 50 for rigidly clamping the light fixture 30 in axial alignment with the base column 14.

In further accordance with the present invention, an exemplary configuration of the lamp 10 includes a pair of task illuminators 54, each of the task illuminators 54 including a task lamphead 56 and a curvable tubular gooseneck 58 supportively connecting the respective lamphead 56 to the housing 16. More particularly, each gooseneck 58 is provided with a counterpart of the hardware 20 on opposite side of the base connector 26 for rigidly connecting a lower end extremity of the gooseneck 58 to the lid member 22. An important feature of the present invention is the goosenecks 58 being sufficiently long for holding a desired shape including a full loop while supporting the lamphead 56.

As shown in FIG. 4, a control switch 60 can be mounted to the lid member 22 for controlling power to the lampheads 56 as well as to the lamp module 28 via the column connector 26.

As shown in FIG. 5, the lid member 22 of the housing 16 is located at a distance B above the bottom of the base member 12, each of the goosenecks 58 having a length G in the straightened condition thereof. The distance B can be from approximately 30 inches to approximately 50 inches, for use of the lamp 10, the length G being from approximately 22 inches to approximately 36 inches. The goosenecks 58 can be formed of a coiled, interlocking metal strip in a conventional manner, the interlocking being produced with a sufficiently frictional fit for supporting the task lampheads in desired positions and orientation, as exemplified in FIGS. 1 and 5. In particular, each gooseneck 58 can be curved in a single plane or in orthogonal planes, as best shown at the left side in FIG. 1.

As shown in FIG. 1, the lamp 10 of the present invention is effective for providing area illumination by means of the main light fixture 30, reading illumination by means of one of the task lampheads 56 as indicated by a chair 62, and wall picture illumination by means of the other task lamphead 56 as indicated by 1 wall hanging 64, the chair 62 and the wall hanging 64 forming no part of the present invention. The lamp 10 is particularly effective in that the task lampheads 56 can be positioned and oriented effectively even with the chair 62 and the wall hanging 64 widely separated as shown in FIG. 1.

As further shown in FIG. 1, a counterpart of the clamp nut 52 can be applied to the shell member 42 when it is desired to omit the main light fixture 30 from the lamp 10, the clamp nut decoratively and protectively covering the base socket 34.

With further reference to FIG. 6, an alternative configuration of the column connector, designated 26', includes a base socket 34' having a pair of spaced contact elements 36' in a single cavity 37. A counterpart of the plug member, designated 46' and having contacts 48' on opposite sides of a projection 49 that entering the cavity 37 when the fixture column 32 is assembled onto the lamp 10. A counterpart of the shell member, designated 42', has at least two projecting bosses 66 formed thereon for engaging corresponding L-shaped channels 68 that are formed in a clamp nut, designated 52'. The L-shaped channels permit axial engagement of the nut 52' over the bosses 66, the main light fixture 30 being clamped in place with electrical contact between the contact elements 36' and the contacts 48' when the nut 52 is rotated for moving the bosses 66 into horizontal leg portions of the respective channels 68.

Although the present invention has been described in considerable detail with reference to certain preferred versions thereof, other versions are possible. For example, the column connector 26 can be located proximate the base member 12, omitting the base column member 14. Also, the base column member 14 can be curved, the column axis 15 being taken proximate the upper end of the base column member 14. Further, the column connector 26 can be oriented at an angle offset from the column axis 15 (side engagement). Some or all of thee goosenecks 58 can be attached directly to either the base column member 14 or the fixture column 32. Moreover, other powered fixtures such as heaters and fans can be substituted for the main lamp fixture and/or the task lampheads 56. Therefore, the spirit and scope of the appended claims should not necessarily be limited to the description of the preferred versions contained herein.

What is claimed is:

1. A floor lamp comprising:

(a) a base;

(b) a base electrical connector mounted in a fixed position relative to the base and having at least two recessed contact elements, the contact elements being oriented for receiving mating contacts, the base electrical connector having electrical conductors extending therefrom for connection to an external source;

(c) a lamp module comprising a module structure, a lamp fixture supported by the structure, a module electrical connector mounted proximate a lower extremity of the structure and having at least two projecting contact elements, the projecting contact elements being oriented for engagement as the mating contacts, and means for electrically connecting the lamp fixture between the projecting contact elements; and (d) means for supportively securing the fixture module on the base electrical connector for powering the fixture from the external source, comprising a ring member and a support element, wherein the ring member is rotatably retained relative to one of the base and the lamp module, and the support element is fixably located relative to the other of the base and the lamp module, the ring member being secured to the support element by rotational engagement therewith.

2. The lamp of claim 1, further comprising an upstanding base column member fixably connected to the base and having a column axis extending from an upper extremity of the column.

3. The lamp of claim 2, wherein the base electrical connector is mounted to an upper extremity of the base column, the electrical conductors extending within the base column.

4. The lamp of claim 3, wherein the base electrical connector is mounted in line with the column axis.

5. The lamp of claim 4, wherein the contact elements are oriented for receiving the mating contacts engaging parallel to the column axis.

6. The lamp of claim 1, wherein the ring member threadingly engages the support element, thereby releasably clamping the lamp module on the base with the contacts in mating engagement.

7. The lamp of claim 6, wherein the support element is a threaded shell member fixedly supported proximate the upper extremity of the base, the ring member being a clamp nut that is retained on the lamp module.

8. The lamp of claim 1, wherein one of the support element and the ring member has a plurality of radially projecting bosses formed thereon, and the other of the support element and the ring member having corresponding L-shaped channels formed therein for engaging the bosses, the bosses entering the channels axially as the ring member engages the support element, the bosses entering horizontal legs of the channels during rotation of the ring member relative to the support element.

9. The lamp of claim 1, further comprising a lamphead, an elongate, curvable neck number having one end fixed relative to the base and a free end connected to the lamphead for supporting the lamphead in a desired position and orientation relative to the base, and means for electrically connecting the lamphead to the electrical conductors of the base electrical connector.

10. The lamp of claim 9, wherein the neck member is sufficiently long for holding a full loop thereof while supporting the lamphead.

11. The lamp of claim 9, wherein the neck member is hollow, the means for electrically connecting the lamphead extends within the neck member.

12. The lamp of claim 9, further comprising a housing fixedly supported above the base, the neck member extending from the housing.

13. The lamp of claim 12, comprising at least two of the neck members supporting respective lampheads, the neck members being connected to the housing.

14. The lamp of claim 12, wherein the base connector is mounted to an upper wall of the housing.

15. A free-standing lamp comprising:

(a) a base;

(b) a housing fixedly supported above the base, a lamphead, an elongated curvable neck member having one end fixed relative to the base and a free end connected to the lamphead for supporting the lamphead in a desired position and orientation relative to the housing, the neck member being sufficiently long for holding a full loop thereof while supporting the lamphead, and electrical conductors extending from the base for connection of the lamphead to an external source;

(c) a base electrical connector mounted in a fixed position relative to the base and having at least two recessed contact elements, the contact elements being oriented for receiving mating contacts, the base electrical connector having electrical conductors extending therefrom for connection to an external source, and means for electrically connecting the lamphead between the electrical conductors;

(d) a fixture module comprising a module structure, a fixture supported by the structure, a module electrical connector mounted proximate a lower extremity of the structure and having at least two projecting contact elements, the projecting contact elements being oriented for engagement as the mating contacts, and means for electrically connecting the fixture between the projecting contact elements; and (e) means for supportively securing the fixture module on the base electrical connector for powering the fixture from the external source, the lamphead also being powered from the external source.

16. A floor lamp comprising:

(a) a base, an upstanding base column fixably connected to the base and having a column axis proximate an upper extremity thereof, a housing fixedly supported proximate the upper extremity of the base column;

(b) a base electrical connector mounted to the housing and having at least two recessed contact elements, the contact elements being oriented for receiving mating contacts engaging parallel to the column axis, the connector having electrical conductors extending within the base column for connection to an external source;

(c) a lamp module comprising a module structure, a holder supported by the structure for receiving an illuminating device, a module electrical connector mounted to a lower extremity of the structure and having at least two projecting contact elements, the projecting contact elements being oriented for engagement as the mating contacts, and means for electrically connecting the illuminating device between the projecting contact elements;

(d) a clamp nut that is rotatably retained on the lamp module for supportively securing the lamp module on the base electrical connector, the clamp nut being formed for rotatably engaging a shall member fixably supported proximate the upper extremity of the base column, thereby releasably clamping the module on the base column with the contacts in mating engagement; and (e) a lamphead, an elongate, hollow curvable neck member mounted in projecting relation to the housing for supporting the lamphead at a free extremity of the neck member in a desired position and orientation relative to the housing, the neck member being sufficiently long for holding a full loop thereof while supporting the lamphead, and means for electrically connecting the lamphead to the electrical conductors of the base column member through the neck member, the base connector being mounted to an upper wall of the housing.

* * * * *